US009905209B2

(12) United States Patent
Kushimiya

(10) Patent No.: US 9,905,209 B2
(45) Date of Patent: Feb. 27, 2018

(54) ELECTRONIC KEYBOARD MUSICAL INSTRUMENT

(71) Applicant: KAWAI MUSICAL INSTRUMENTS MANUFACTURING CO., LTD., Hamamatsu-shi, Shizuoka-ken (JP)

(72) Inventor: Kiyomichi Kushimiya, Hamamatsu (JP)

(73) Assignee: KAWAI MUSICAL INSTRUMENTS MANUFACTURING CO., LTD., Hamamatsu-shi (JP)

( * ) Notice: Subject to any disclaimer, the term of this patent is extended or adjusted under 35 U.S.C. 154(b) by 0 days.

(21) Appl. No.: 15/607,900

(22) Filed: May 30, 2017

(65) Prior Publication Data

US 2017/0345404 A1 Nov. 30, 2017

(30) Foreign Application Priority Data

May 30, 2006 (JP) ..... 2016-107716

(51) Int. Cl.
*G10H 1/18* (2006.01)
*G10H 1/34* (2006.01)
*G10H 1/02* (2006.01)

(52) U.S. Cl.
CPC ..... *G10H 1/344* (2013.01); *G10H 1/02* (2013.01)

(58) Field of Classification Search
CPC ..... G10H 1/18; G10H 1/344
USPC ..... 84/615, 658
See application file for complete search history.

(56) References Cited

U.S. PATENT DOCUMENTS

2015/0269922 A1 9/2015 Matsunaga

FOREIGN PATENT DOCUMENTS

JP 2015-184392 10/2015

*Primary Examiner* — David Warren
(74) *Attorney, Agent, or Firm* — Grossman, Tucker, Perreault & Pfleger, PLLC

(57) ABSTRACT

An electronic keyboard musical instrument with a plurality of keys is provided. The electronic keyboard musical instrument comprises a detection sensor configured to detect a gentle key press to an adjacent position that is shallower than and adjacent to a resonant performance position; a computer configured to, when the detection sensor detects a gentle key press to the adjacent position of at least one first key, execute a resonance permission process to give a permission to output a resonant tone of the at least one first key; and a tone emission device configured to, when at least one second key different from the at least one first key and having a resonant relationship with the at least one first key is regularly pressed, emit a regular tone of the at least one second key and the resonant tone of the at least one first key.

5 Claims, 10 Drawing Sheets

ELECTRONIC KEYBOARD MUSICAL INSTRUMENT

CROSS-REFERENCE TO RELATED APPLICATIONS

This application claims the benefit of Japanese Patent Application No. 2016-107716 filed on May 30, 2016 with the Japan Patent Office, and the entire disclosure of Japanese Patent Application No. 2016-107716 is incorporated herein by reference.

BACKGROUND

The present disclosure relates to an electronic keyboard musical instrument.

As described, for example, in Japanese Unexamined Patent Application Publication No. 2015-184392, an electronic keyboard musical instrument is known in which, by depressing a damper pedal, when one or more keys are regularly pressed, resonant tones of the remaining keys that are not regularly pressed may be outputted.

SUMMARY

An acoustic piano comprises dampers (tone muting mechanisms that contact strings to stop string vibrations to thereby mute tones) each provided for a corresponding key. When a key is gently pressed to such an extent that a corresponding one of the dampers is raised, a resonant tone at a note of the gently pressed key is ready to be emitted.

In contrast, an electronic keyboard musical instrument having no damper has not been configured to output a resonant tone of any specific key selected from among all keys. Thus, when it is desired to output a resonant tone of a specific key using an electronic keyboard musical instrument, a pseudo resonant tone is outputted.

Specifically, in an electronic keyboard musical instrument, as a key pressing velocity is slower, a tone at a lower volume level is outputted; thus, a specific key of a note, at which a resonant tone is desired to be outputted, is regularly pressed at an extremely low speed to output an extremely small regular tone, thereby outputting a pseudo resonant tone of the specific key.

However, such an operation of regularly pressing a key at an extremely low speed is a quite delicate operation. Thus, when using an electronic keyboard musical instrument, a player cannot make a performance outputting a resonant tone of a specific key with a similar feeling of performance to that when playing an acoustic piano.

In the present disclosure, it is preferable to provide an electronic keyboard musical instrument that enables to output a resonant tone of a specific key with a similar feeling of performance to that when playing an acoustic piano.

An electronic keyboard musical instrument of the present disclosure comprises a detection sensor configured to detect a gentle key press, the detection sensor detecting that a key is gently pressed to an adjacent position that is shallower than and adjacent to a resonant performance position, the resonant performance position corresponding to a key press position to allow a damper to leave a string in an acoustic piano; a computer configured to, when the detection sensor detects a gentle key press to the adjacent position of at least one first key, among the plurality of keys, execute a resonance permission process to give a permission to output a resonant tone of the at least one first key; and a tone emission device configured to, when at least one second key different from the at least one first key and having a resonant relationship with the at least one first key is regularly pressed, emit a regular tone of the at least one second key and the resonant tone of the at least one first key.

As used herein, the term "regularly press a key" refers to an operation of regularly pressing a key so as to emit a tone, whereas the term "gently press a key" refers to an operation of gently pressing a key so as not to emit a tone.

With the above described configuration, when a key is gently pressed to the adjacent position shallower than the resonant performance position, a resonant tone of the key can be outputted individually; thus, the electronic keyboard musical instrument enables performance outputting a resonant tone of a specific key with a similar feeling of performance to that when playing an acoustic piano.

The electronic keyboard musical instrument of the present disclosure may comprise at least two key press sensors configured to detect a gentle key press at at least two different key press depth positions, in order to detect a key pressing velocity. In this case, at least one of the key press sensors that is configured to detect a gentle key press at the adjacent position shallower than the resonant performance position may be used as the detection sensor to detect a gentle key press at the adjacent position shallower than the resonant performance position.

With this configuration, it is possible to use the key press sensor for detecting a key pressing velocity as the detection sensor to detect a gentle key press to the adjacent position that is adjacent to the resonant performance position, and thus a simplified configuration of the electronic keyboard musical instrument can be achieved.

The computer in the electronic keyboard musical instrument of the present disclosure may be configured to, when the detection sensor detects a gentle key press of the at least one first key, set a resonant tone flag to give a permission to output the resonant tone of the at least one first key. In this case, the tone emission device may be configured to emit the resonant tone of the at least one first key for which the resonant tone flag is set. The electronic keyboard musical instrument with this configuration can easily emit a resonant tone by a flag process.

The electronic keyboard musical instrument of the present disclosure may be configured to execute a release determination process to determine whether the gentle key press of the at least one first key, for which the permission to output the resonant tone is given in the resonance permission process, is released; and a cancellation process, when it is determined in the release determination process that the gentle key press of the at least one first key is released, to cancel the permission in the resonance permission process for the at least one first key.

With such configuration, output of a resonant tone of a specific key can be stopped individually by a key release operation with a similar feeling to that when playing an acoustic piano.

The electronic keyboard musical instrument of the present disclosure may further comprise a sostenuto pedal, and may be configured such that the computer executes an operation determination process, when it is determined in the release determination process that the gentle key press is released, to determine whether an operation of the sostenuto pedal is performed before the gentle key press. Also, the electronic keyboard musical instrument may be configured such that the computer executes a cancellation suspension process, when it is determined in the operation determination process that the operation of the sostenuto pedal is performed, to suspend cancellation of the permission until the operation of the sostenuto pedal is released.

With such configuration, by performing a series of actions to gently press a specific key to an extent to allow output of a resonant tone, to depress the sostenuto pedal, and then to release the specific key in a similar manner as on an acoustic piano, the resonant tone of the specific key can be outputted even after releasing the specific key.

BRIEF DESCRIPTION OF THE DRAWINGS

An embodiment of the present disclosure will be described hereinafter by way of example with reference to the accompanying drawings, in which.

DETAILED DESCRIPTION

A description of an embodiment hereinafter shows only necessary configurations for convenience; however, this does not mean that an electronic piano 1 is configured only by these configurations.

Figure 1:
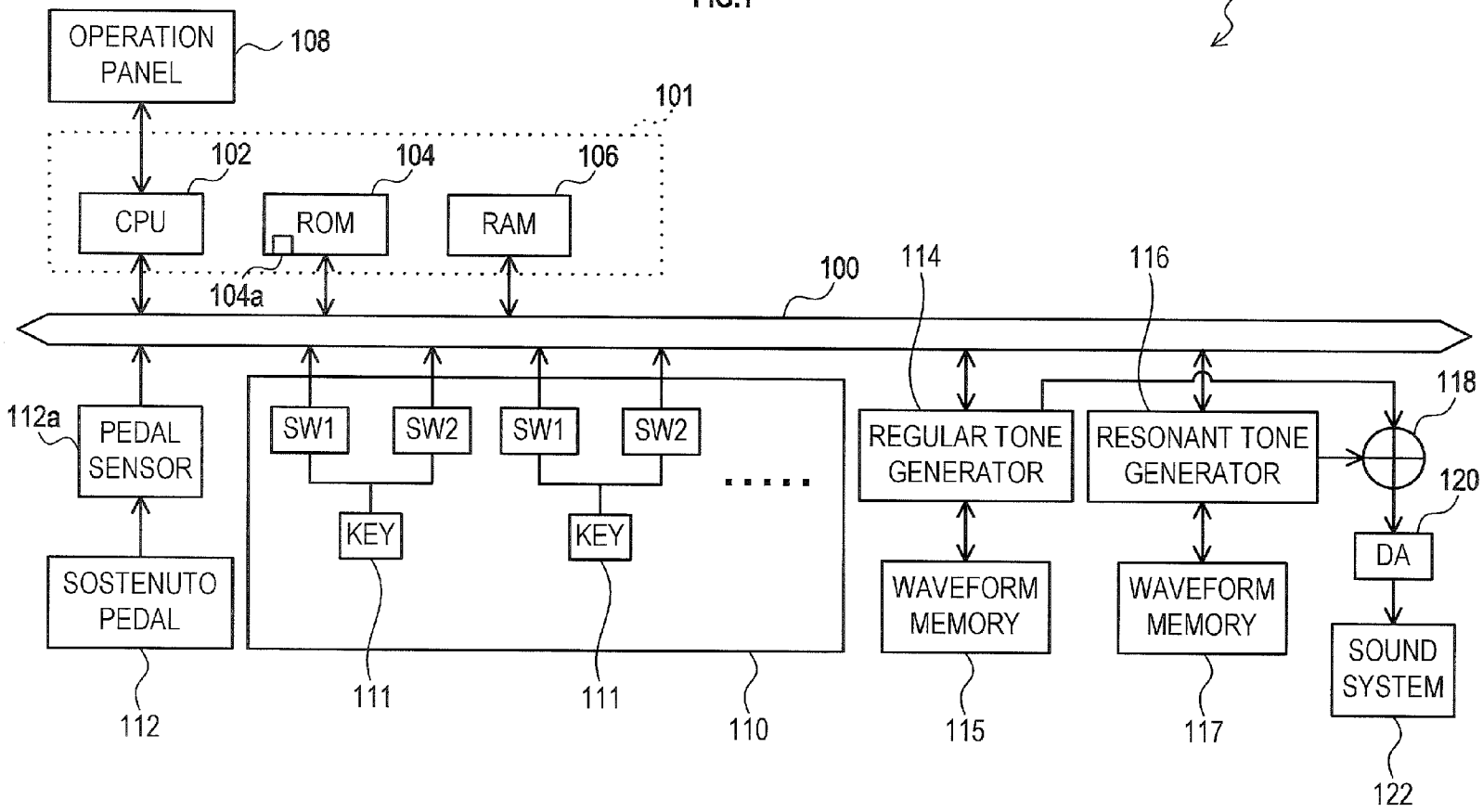
FIG. 1 is a block diagram showing an internal configuration of an electronic piano according to the embodiment.

As shown in FIG. 1, the electronic piano 1 of the present embodiment comprises a central controller 101 comprising a CPU 102, a ROM 104, and a RAM 106.

The CPU 102, the ROM 104, the RAM 106, and other devices are communicably coupled to one another through a system bus 100. The CPU 102 communicates with the ROM 104, the RAM 106, and other devices through the system bus 100 to execute various processes as described later.

The ROM 104 comprises a program memory 104*a* that stores programs to be executed by the CPU 102.

The RAM 106 temporarily stores flag information and other information generated when the CPU 102 executes the various processes. In the present embodiment, an SW1 flag, an SW2 flag, a tone emission flag, a key damper flag, a mute flag, and a pedal operation flag are stored in the RAM 106 so as to correspond to each of a plurality of keys 111.

The electronic piano 1 comprises an operation panel 108, a keyboard 110, and a sostenuto pedal 112 as configurations of an operation system.

The operation panel 108 comprises a plurality of switches for setting various functions of the electronic piano 1. The plurality of switches comprise, for example, a timbre switch to select a timbre of a tone. Operation information indicating that any of the switches is operated is outputted to the CPU 102, and the CPU 102 executes the various processes in accordance with the operation information.

The keyboard 110 comprises eighty-eight keys 111, and a key press sensor SW1 and a key press sensor SW2 are provided to each of the keys 111. Each of the key press sensor SW1 and the key press sensor SW2 may be an optical sensor. The key press sensors SW1, SW2 detect an operation (key press) of a corresponding one of the keys 111 at different depth positions. In the present embodiment, the key press sensor SW1 is arranged at an adjacent position shallower than a resonant performance position that enables, in an acoustic piano, a damper to be raised to cause resonance of a string. Detection information outputted from the key press sensors SW1, SW2 is outputted to the CPU 102 through the system bus 100.

The sostenuto pedal 112 comprises a pedal sensor 112*a*. An operation of the sostenuto pedal 112 is detected by the pedal sensor 112*a*, and then detection information is outputted to the CPU 102. The CPU 102 determines occurrence or non-occurrence of an operation of the sostenuto pedal 112 based on the detection information from the pedal sensor 112*a*. The pedal sensor 112*a* may be, for example, an optical sensor or may be another type of sensor.

The electronic piano 1 comprises, as a configuration to generate and output a tone, a regular tone generator 114, a resonant tone generator 116, an adder 118, a DA converter 120, and a sound system 122.

The regular tone generator 114 is a tone generator, which comprises channels to be time division controlled in order to emit a plurality of tones simultaneously. The electronic piano 1 is capable of outputting a regular tone that is usually generated when a key 111 is regularly pressed and a resonant tone (a string resonance) that is generated when a string is caused to resonate with another string. The regular tone generator 114 is a device that is configured to generate regular tones.

The regular tone generator 114 comprises a tone waveform data memory (hereinafter, a "waveform memory") 115, and the waveform memory 115 stores waveform data (PCM waveform data, PCM: Pulse Code Modulation) representing respective pitches of the keys 111, envelop data corresponding to key pressing velocities, and other data.

The regular tone generator 114 reads, from the waveform memory 115, the waveform data of respective regular tones of keys 111 for each of which a tone emission flag is set in the RAM 106, the envelop data stored in the RAM 106 and corresponding to velocity information of the respective keys 111 corresponding to the tone emission flags, and others. Then, the regular tone generator 114 assigns the read data (tone signals, such as the waveform data and the envelop data) to respective channels, and combines all tone signals assigned to the respective channels, and outputs the combined tone signals (in other words, regular tone signals) to the adder 118.

The resonant tone generator 116 is also a tone generator, which is a device configured to generate resonant tones.

The resonant tone generator 116 comprises a tone waveform data memory (hereinafter, a "waveform memory") 117. The waveform memory 117 stores waveform data representing respective pitches of resonant tones that are to be emitted when respective strings of the keys 111 resonate in a case of an acoustic piano, and other data.

When a later-described SW2 flag is set to a first key 111 (in other words, the first key 111 is regularly pressed), the resonant tone generator 116 reads, from the waveform memory 117, waveform data of respective resonant tones of the second keys 111 which have resonant relationships with the first key 111 and for which key damper flags are set in the RAM 106; assigns the read waveform data (tone signals) to respective channels. The resonant tone generator 116 then combines all tone signals assigned to the respective channels; and outputs the combined tone signals (in other words, resonant tone signals) to the adder 118.

The adder 118 adds resonant tones to a corresponding regular tone based on the regular tone signal and the resonant tone signals, and transmits the added tone signals for the added tones to the DA converter 120.

The DA converter 120 converts the tone signals (digital signals) transmitted from the adder 118 to analog signals, and transmits the converted analog signals to the sound system 122.

The sound system 122, which comprises an amplifier, a speaker, and other components, externally outputs tones based on the analog signals transmitted from the DA converter 120.

Next, descriptions will be given of the various processes, which are executed mainly by the CPU 102 of the electronic piano 1 configured as described above, with reference to flowcharts in FIG. 2 to FIG. 10.

Figure 2:
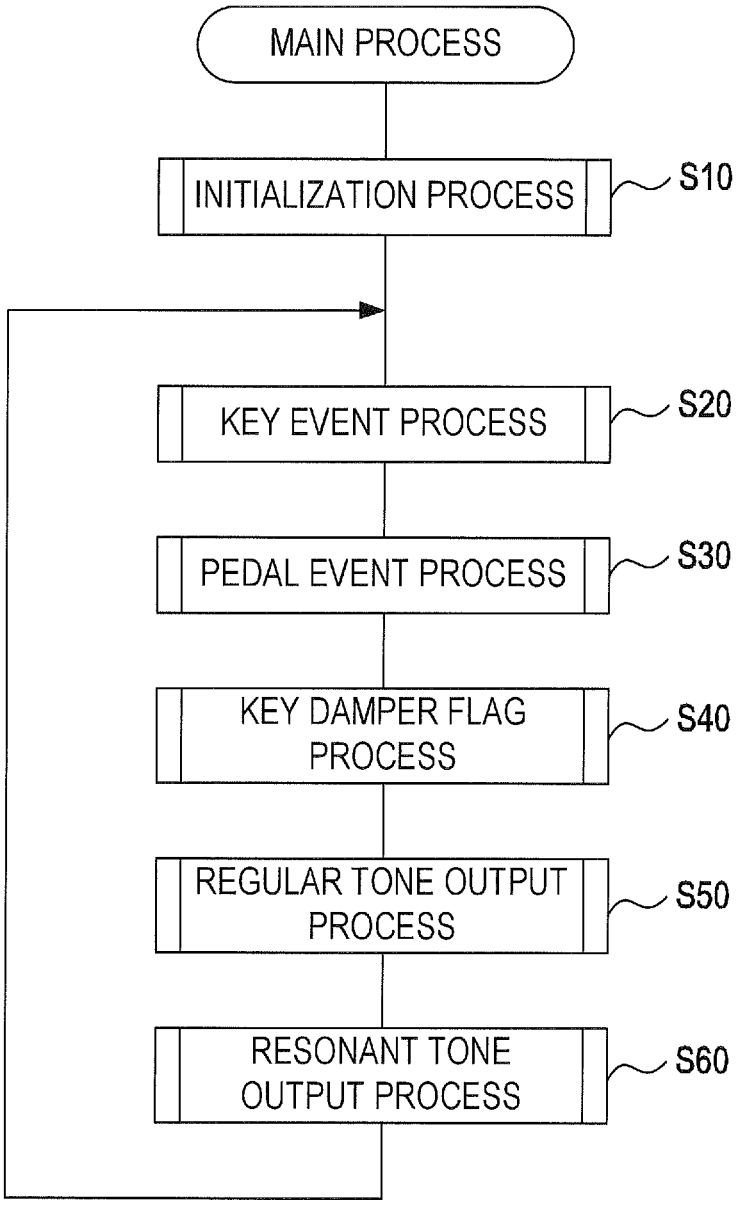
FIG. 2 is a flowchart of a main process.

In the electronic piano 1, when a power switch (not shown) is turned on, a main process shown in FIG. 2 is executed. In the main process, an initialization process S10 is executed, and then subsequent processes, i.e., a key event process S20, a pedal event process S30, a key damper flag process S40, a regular tone output process S50, and a resonant tone output process S60, are repeatedly executed in this order.

In the initialization process S10, a process of initializing the RAM 106, the regular tone generator 114, the resonant tone generator 116, and other components is executed. Since the initialization process here is a general process, no further detailed description will be given.

Figure 3:
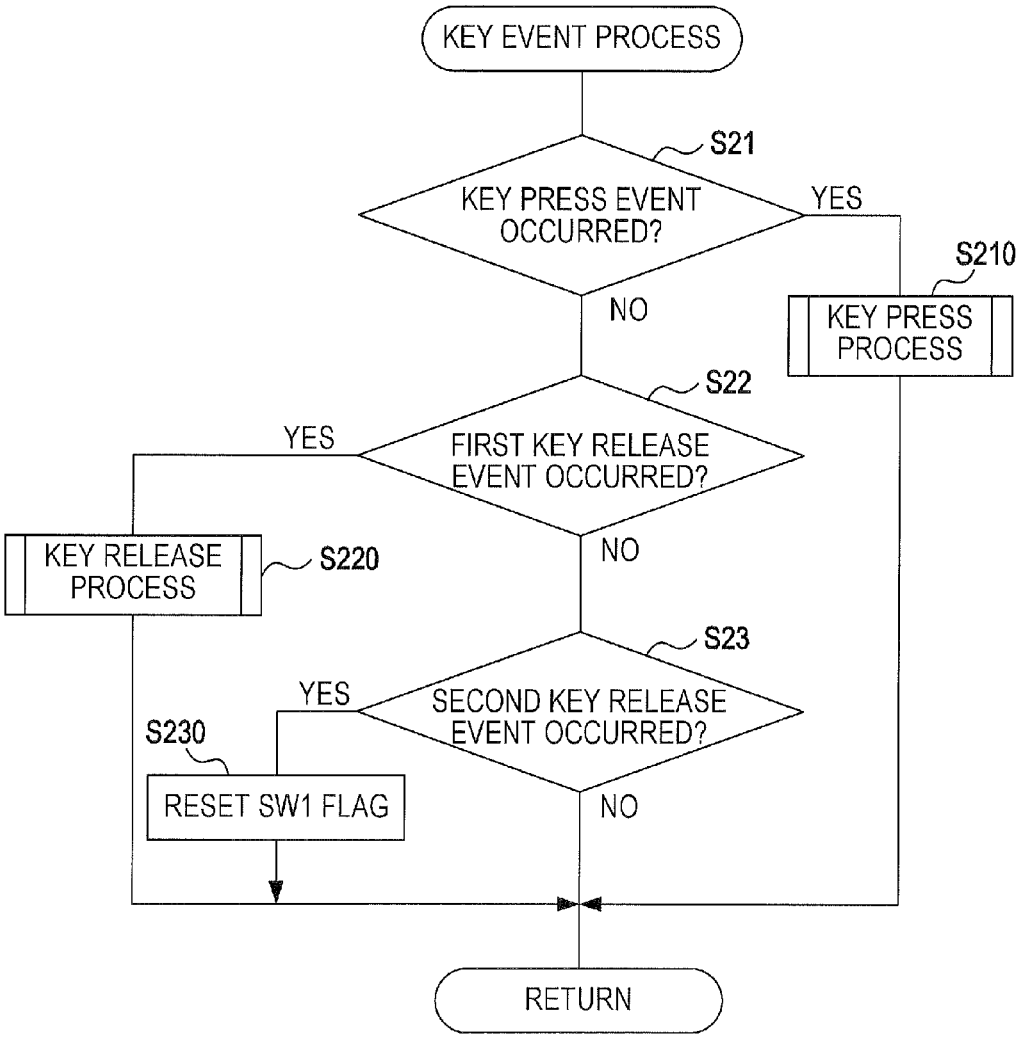
FIG. 3 is a flowchart of a key event process.
Figure 4:
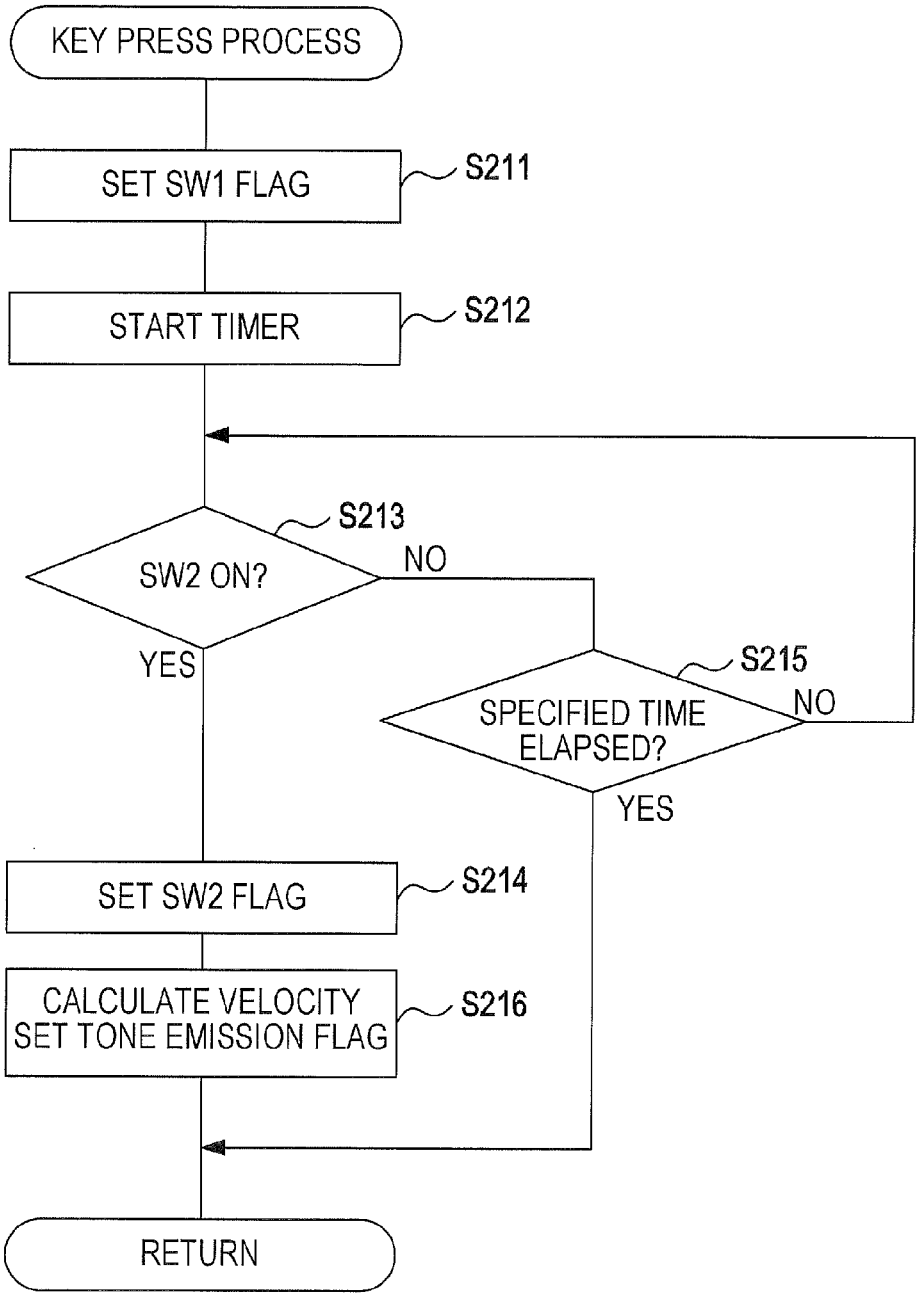
FIG. 4 is a flowchart of a key press process.
Figure 5:
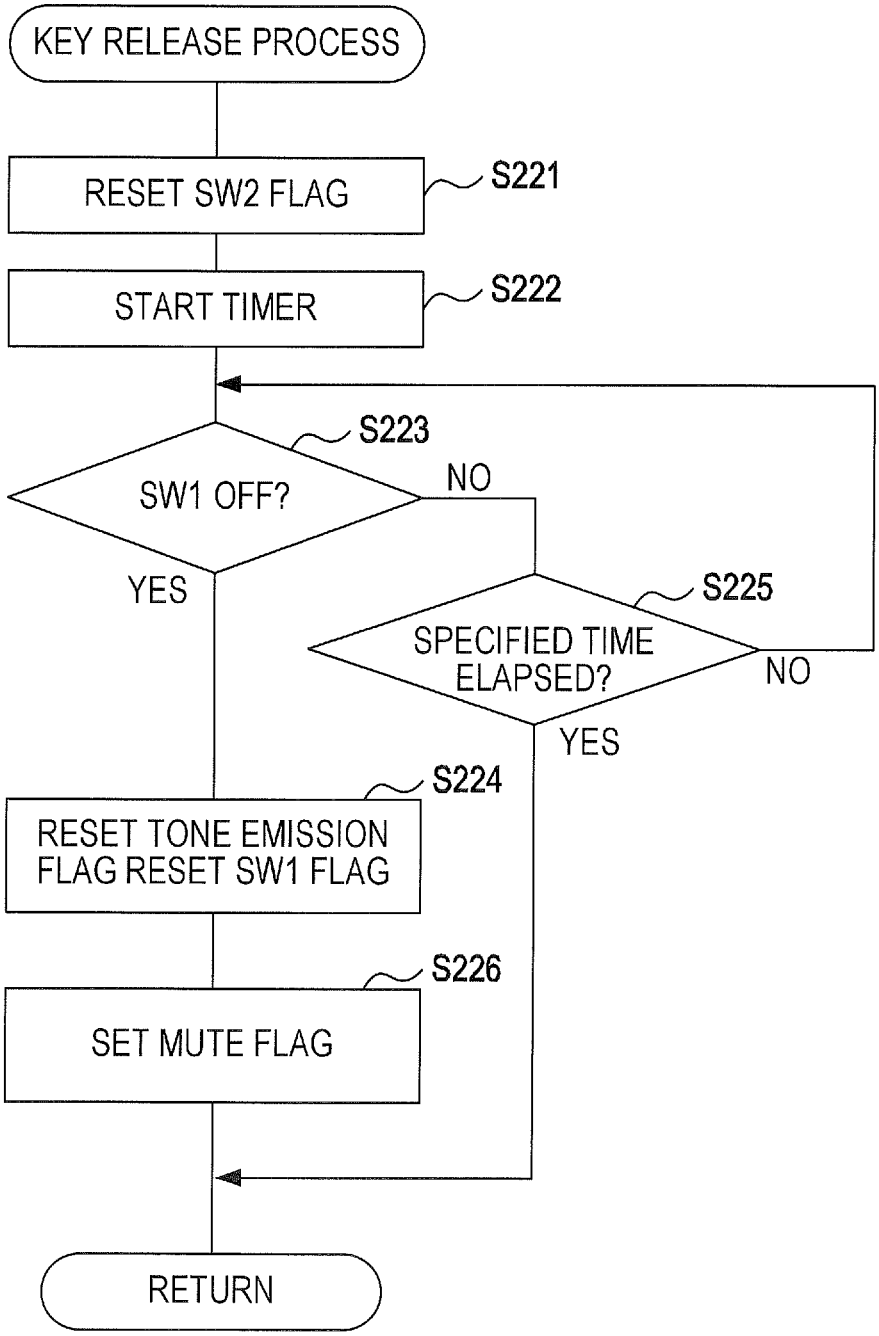
FIG. 5 is a flowchart of a key release process.

In the key event process S20, specific processes shown in FIG. 3 to FIG. 5 are executed. In the key event process S20, a key press process S210 (FIG. 3, FIG. 4) is a process that is executed when a key 111 is pressed. In the key event process S20, a key release process S220 (FIG. 3, FIG. 5) is a process that is executed when a key 111 is released. If no key 111 is pressed or released, a negative determination (NO) is made in each of later-described steps S21 to S23, and thus the key press process S210 or the key release process S220 is not executed.

As shown in FIG. 3, in the key event process S20, it is first determined whether a key press event has occurred (S21). If a key is pressed, the key press is detected by the key press sensor SW1 and the key press sensor SW2 in this order (that is, in ascending order of key press depth). Specifically, in S21, it is determined whether the key press sensor SW1 has detected a key press. If the key press sensor SW1 has detected a key press, a corresponding detection signal is outputted to the CPU 102. The CPU 102 determines in S21 whether any detection signal is inputted from the key press sensor SW1.

If it is determined in S21 that no detection signal indicating a key press of any key 111 is inputted (S21: NO), then S22 is executed. If it is determined in S21 that a detection signal is inputted (S21: YES), then the key press process in S210 is executed.

In S22, it is determined whether a first key release event has occurred. When a key release is performed, the key release is detected by the key press sensor SW2 and the key press sensor SW1 in this order (that is, in descending order of key press depth). Specifically, in S22, it is determined whether the key press sensor SW2 has detected a key release. If the key press sensor SW2 has detected a key release, a corresponding detection signal is outputted to the CPU 102. The CPU 102 determines in S22 whether any detection signal is inputted from the key press sensor SW2.

If it is determined in S22 that no detection signal indicating a key release of any key 111 is inputted (S22: NO), then S23 is executed. If it is determined in S22 that a detection signal is inputted (S22: YES), then the key release process in S220 is executed.

In S23, it is determined whether a second key release event has occurred. In the present embodiment, a performance method as on an acoustic piano is available in which a resonant tone of a key is ready to be outputted by a gentle key press of the key to an extent where a corresponding damper leaves a string. In this case, the key press sensor SW1, which is arranged at the adjacent position shallower than the resonant performance position that is a key press position enabling the aforementioned performance method, detects the gentle key press; whereas, the key press sensor SW2, which is arranged at a deeper position than the resonant performance position, does not detect the gentle key press. In the case of such a gentle key press, it is not determined in S22 that a key release has occurred, and thus it is determined in S23 whether the key press sensor SW1 has detected a key release in the present embodiment.

If it is determined in S23 that no detection signal indicating a key release is inputted from the key press sensor SW1 (S23: NO), the key event process S20 is terminated, and the present process returns to the main process. If it is determined in S23 that a detection signal is inputted (S23: YES), a process of resetting a later-described SW1 flag is executed (S230), and then the key event process S20 is terminated, and the present process returns to the main process.

If it is determined in S225 of the key release process S220, which will be described later, that a specified time has elapsed, and the processes beginning from S20 are executed again, the same determination is not made in S22 since it has been determined YES in the previous process in S22 and the SW2 flag is already reset in the subsequent process in S221. Specifically, it is not determined in the current process in S22 that a key release has occurred based on resetting of the SW2 flag. However, in subsequent S23, it may be determined that a key release has occurred based on an input of a detection signal indicating a key release from the key press sensor SW1. In such case, the process in S230 is subsequently executed, and also processes of resetting a tone emission flag and setting a mute flag are executed in S230 in place of the processes in S224 and S226.

A description of the key press process S210 will be given with reference to FIG. 4. When the key press process S210 is started, a process of setting a SW1 flag is first executed (S211). One SW1 flag for each key 111, which is set or reset, is stored in the RAM 106.

Next, a process is executed to start a timer for measuring a time to determine whether an operation that can be regarded as a gentle key press has been performed on a key 111 (S212), and it is determined whether a detection signal is inputted indicating that the key press sensor SW2 has detected a gentle key press within a specified time period measured by the timer (S213).

If it is determined in S213 that a detection signal is inputted from the key press sensor SW2 (S213: YES), it is determined that a regular key press has occurred, and then S214 is executed. Specifically, in S214, a process of setting an SW2 flag of the key press sensor SW2 is executed. One SW2 flag for each key 111 is stored in the RAM 106.

If it is determined in S213 that no detection signal is inputted from the key press sensor SW2 (S213: NO), then S215 is executed. Specifically, in S215, a process is executed to determine whether a measured time by the timer started in S212 has reached a specified time (i.e., whether the specified time has elapsed).

If it is determined in S215 that the specified time has not elapsed (S215: NO), S213 is executed again, and the processes from S213 to S215 are repeatedly executed until a regular key press is detected by the key press sensor SW2 or the specified time has elapsed.

If it is determined in S215 that the specified time has elapsed (S215: YES), the key press process S210 is terminated, and the present process returns to the main process.

If the process of setting the SW2 flag in S214 is completed, a process of calculating a key pressing velocity ("velocity") is executed in S216. Specifically, calculation is performed based on a time from a detection of the key press by the key press sensor SW1 until a detection of the regular key press by the key press sensor SW2, which is a time from starting of the timer in S212 until the determination in S213 that a detection signal is inputted from the key press sensor SW2 (S216).

In S216, a process of setting a tone emission flag is also executed. One tone emission flag for each key 111 is stored in the RAM 106.

When S216 is completed, the key press process S210 is terminated, and the present process returns to the main process.

A description of the key release process S220 will be given with reference to FIG. 5.

When the key release process S220 is started, a process of resetting the SW2 flag of the key press sensor SW2 is first executed (S221). Specifically, the SW2 flag for each key 111 is stored in the RAM 106 as described above, and the process in S221 is executed to reset the SW2 flag of the key press sensor SW2 that has outputted the detection signal for the key 11 detected in S22.

Next, a process is executed to start a timer for measuring a time to determine whether an operation that can be regarded as a key release has been performed on the key 111 (S222). It is determined whether a detection signal is inputted indicating that the key press sensor SW1 has detected a key release within a specified time period measured by the timer (S223).

If it is determined in S223 that a detection signal is inputted from the key press sensor SW1 (S223: YES), then S224 is executed. Specifically, in S224, a process is executed to reset the SW1 flag of the key press sensor SW1 that has outputted the detection signal for the key 111 detected in S22. Also in S224, a process of resetting the tone emission flag set in S216 (see FIG. 4) is executed.

If it is determined in S223 that no detection signal is inputted from the key press sensor SW1 (S223: NO), then S225 is executed. Specifically, in S225, a process is executed to determine whether a measured time by the timer started in S222 has reached a specified time (i.e., whether the specified time has elapsed).

If it is determined in S225 that the specified time has not elapsed (S225: NO), S223 is executed again, and the processes from S223 to S225 are repeatedly executed until a regular key press is detected by the key press sensor SW2 or the specified time has elapsed.

If it is determined in S225 that the specified time has elapsed (S225: YES), the key release process S220 is terminated, and the present process returns to the main process.

Meanwhile, when the process of resetting the SW1 flag is completed in S224, then a process of setting a mute flag is executed in S226. One mute flag for each key 111, which is set or reset, is stored in the RAM 106.

When S226 is completed, the key release process S220 is terminated, and the present process returns to the main process.

Figure 6:
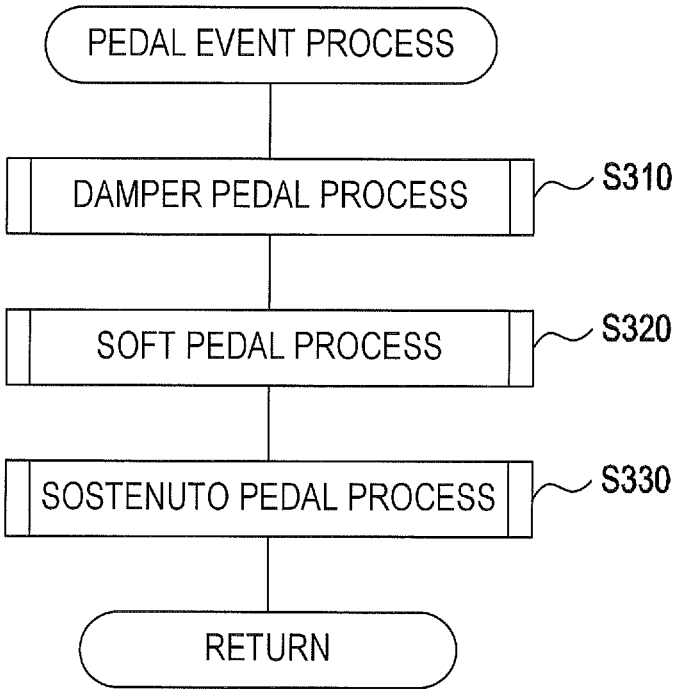
FIG. 6 is a flowchart of a pedal event process.

Next, a description will be given of the pedal event process S30, which is executed subsequent to the key event process S20 in the main process shown in FIG. 2, with reference to FIG. 6.

In S30, it is determined if any of a damper pedal (not shown), a soft pedal (not shown), and the sostenuto pedal 112 (shown in FIG. 1) is operated. If it is determined that any of the pedals is operated, a damper pedal process S310, a soft pedal process S320, or a sostenuto pedal process S330 corresponding to the operated pedal is executed. If it is determined that none of the pedals is operated, none of these pedal processes (S310, S320, S330) is executed.

Figure 7:
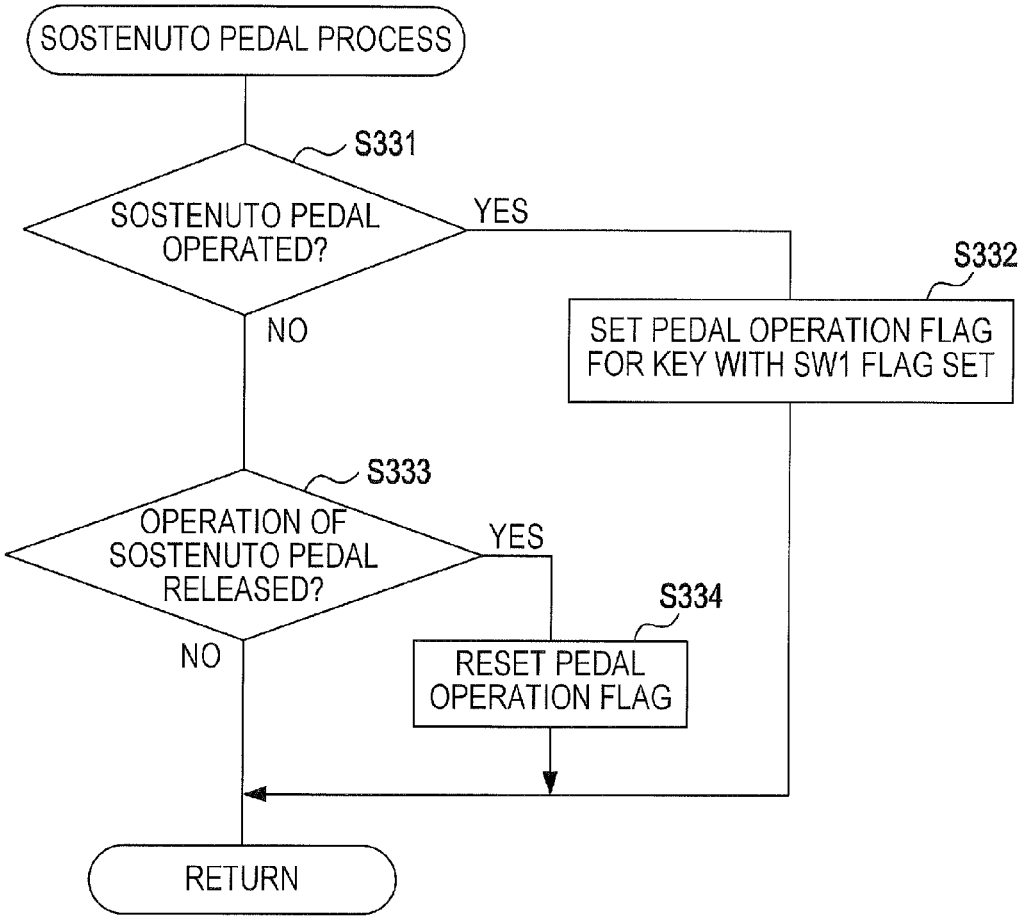
FIG. 7 is a flowchart of a sostenuto pedal process.

Hereinafter, a description will be given of the sostenuto pedal process S330 executed when the sostenuto pedal 112 is operated with reference to FIG. 7. No detailed description will be given herein about any of the pedal processes (S310, S320) executed when the damper pedal or the soft pedal is operated.

In the sostenuto pedal process S330, it is first determined whether the pedal sensor 112*a* has detected an operation of the sostenuto pedal 112 (S331).

If it is determined in S331 that the sostenuto pedal 112 is operated (S331: YES), then a process is executed to set a pedal operation flag for each of one or more keys 111 for each of which the SW1 flag is set (S332), and the sostenuto pedal process S330 is terminated.

If it is determined in S331 that the sostenuto pedal 112 is not operated (S331: NO), then it is determined in S333 whether operation of the sostenuto pedal 112 is released. If it is determined in S333 that operation of the sostenuto pedal 112 is released (S333: YES), then S334 is executed. Specifically, in S334, a process of resetting the pedal operation flag for any of the keys 111 is executed, and then the sostenuto pedal process S330 is terminated. If it is determined in S333 that operation of the sostenuto pedal 112 is not released (S333: NO), the sostenuto pedal process S330 is terminated immediately, and the present process returns to the main process.

Next, a description will be given of the key damper flag process S40, which is executed subsequent to the pedal event process S30 in the main process shown in FIG. 2, with reference to FIG. 8.

Figure 8:
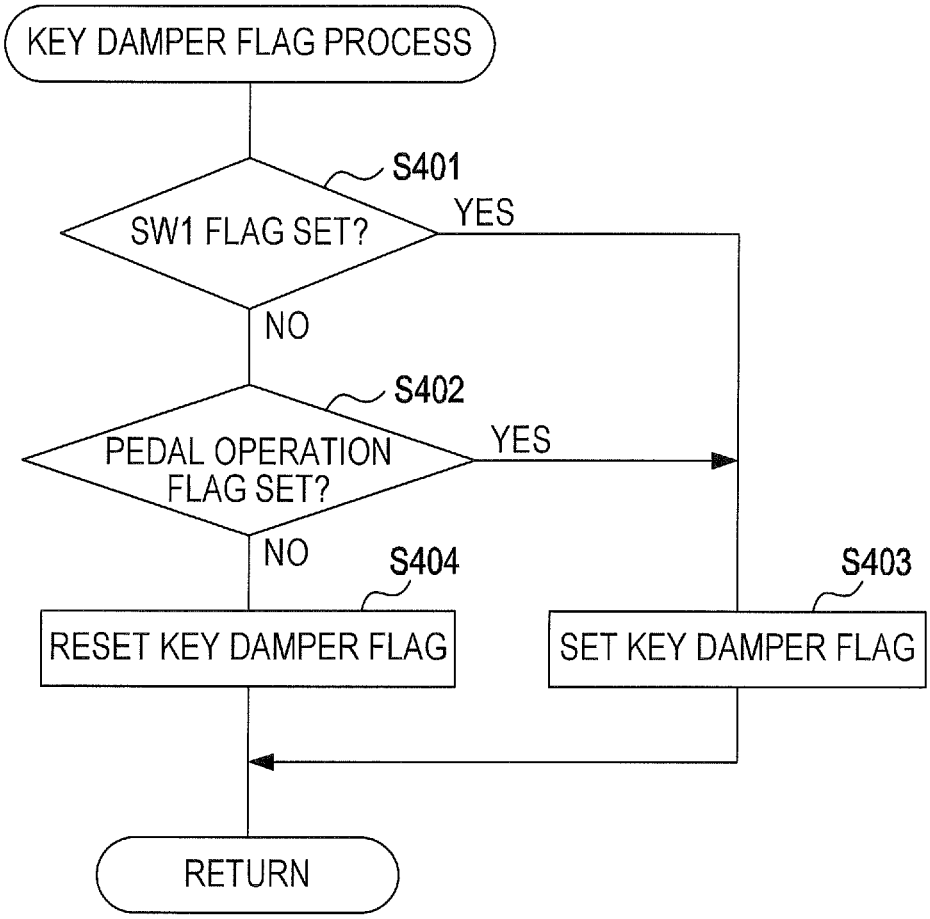
FIG. 8 is a flowchart of a key damper flag process.

As shown in FIG. 8, in the key damper flag process S40, a process is first executed to determine whether there is any key 111 for which the SW1 flag of the key press sensor SW1 is set (S401). If it is determined in S401 that there is any key 111 for which the SW1 flag of the key press sensor SW1 is set (S401: YES), then a process in S403 is executed. If it is determined in S401 that there is no key 111 for which the SW1 flag of the key press sensor SW1 is set (S401: NO), then a process in S402 is executed.

The process executed in S402 is to determine whether there is any key 111 for which the pedal operation flag is set. If it is determined in S402 that there is any key 111 for which the pedal operation flag is set (S402: YES), then the process in S403 is executed. If it is determined in S402 that there is no key 111 for which the pedal operation flag is set (S402: NO), then a process in S404 is executed.

The process executed in S403 is to set key damper flags for all of the keys 111 for each of which it is determined in S401 that the SW1 flag of the key press sensor SW1 is set, and for all of the keys 111 for each of which it is determined in S402 that the pedal operation flag is set. When the process of setting the key damper flags is completed, then the key damper flag process S40 is terminated, and the present process returns to the main process.

The process in S404 is executed when it is determined in S401 and S402 that the SW1 flag of the key press sensor SW1 or the pedal operation flag is not set. In S404, if there are any keys 111 for each of which the key damper flag is set, then all of the key damper flags are reset, whereas if there is no key 111 for which the key damper flag is set, the process is simply terminated. When the process in S404 is completed, then the key damper flag process S40 is terminated, and the present process returns to the main process.

Next, a description will be given of a regular tone output process S50, which is executed subsequent to the key damper flag process S40 in the main process shown in FIG. 2, with reference to FIG. 9.

Figure 9:
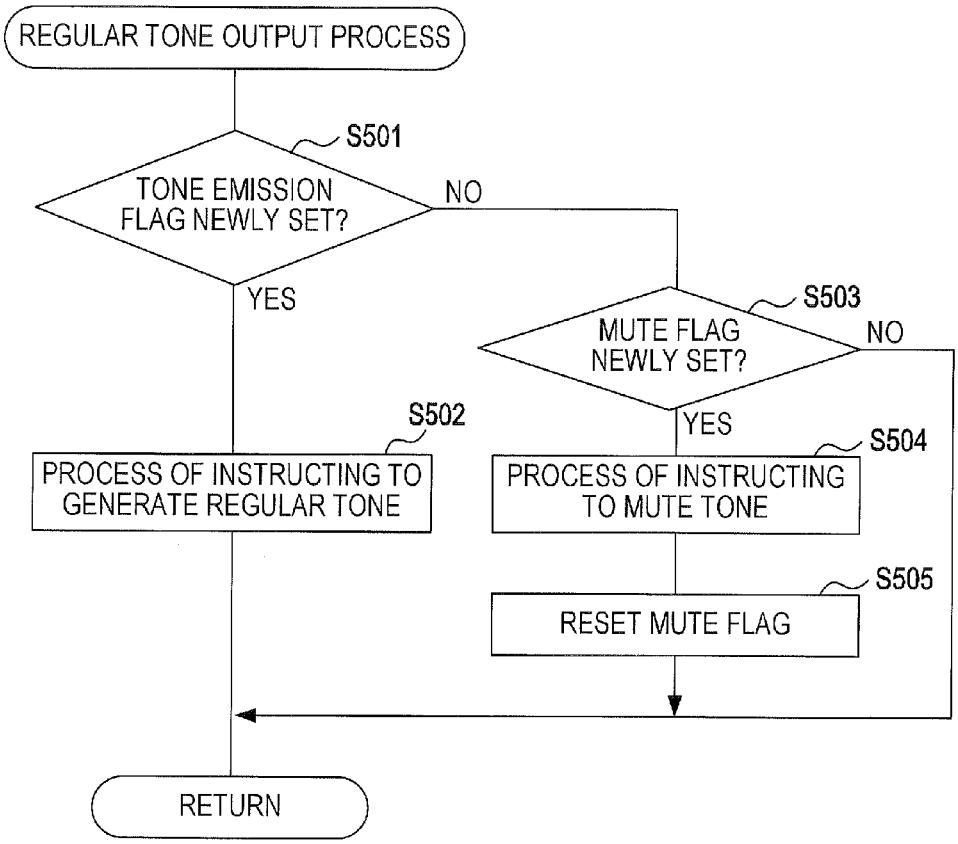
FIG. 9 is a flowchart of a regular tone output process.

As shown in FIG. 9, in the regular tone output process S50, it is first determined in S501 whether a tone emission flag is newly set in the process of S216 (see FIG. 4). If it is determined that a tone emission flag is newly set (S501: YES), a process is executed to instruct the regular tone generator 114 to generate a new regular tone (S502).

When the process in S502 is executed, the regular tone generator 114 detects for which key 111 the new regular tone is instructed to be generated with reference to the RAM 106, and outputs the new regular tone based on velocity information and others.

If it is determined in S501 that no tone emission flag is newly set (S501: NO), then it is determined in S503 whether there is any key 111 for which a mute flag is newly set in the process in S226 (see FIG. 5), that is, it is determined whether any key 111 is released. If it is determined that a mute flag is newly set (S503: YES), then a process is executed to instruct the regular tone generator 114 to mute a tone of the key 111 corresponding to the mute flag (S504).

When receiving information to instruct muting, the regular tone generator 114 stops outputting the tone. Accordingly, thereafter, tones except the tone that is instructed to be muted are to be outputted from the regular tone generator 114.

When the process in S504 is completed, the mute flag is reset (S505) and the regular tone output process S50 is terminated, and then the present process returns to the main process.

Figure 10:
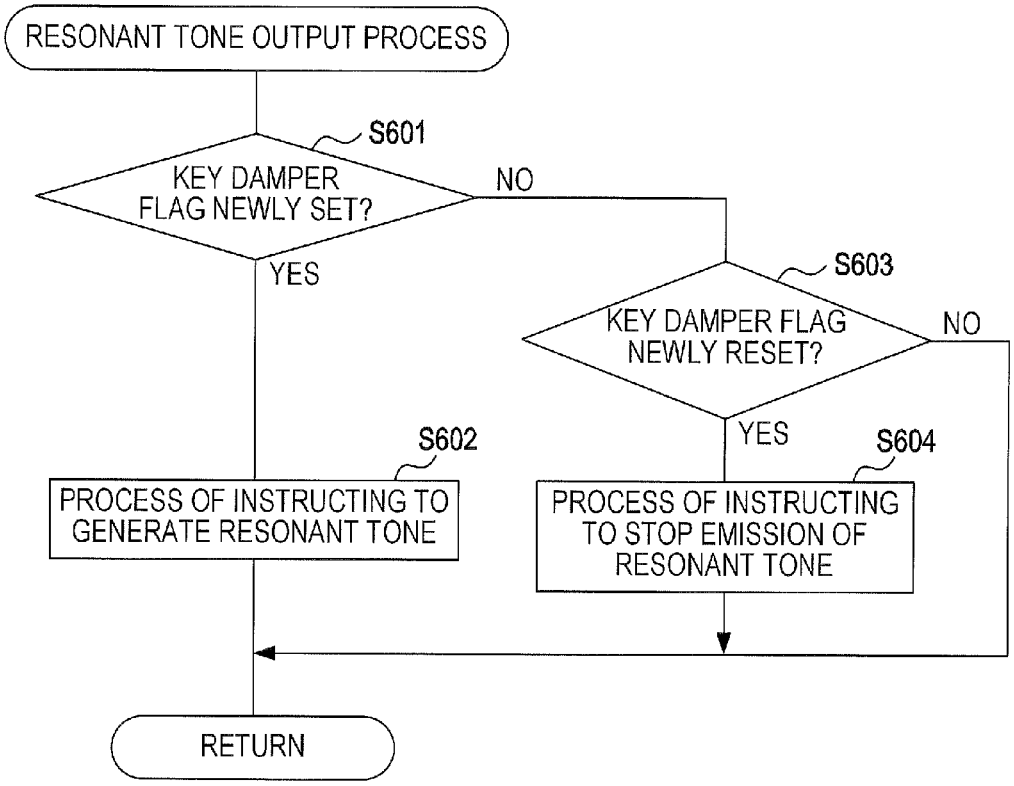
FIG. 10 is a flowchart of a resonant tone output process.

Next, a description will be given of a resonant tone output process S60, which is executed subsequent to the regular tone output process S50 in the main process shown in FIG. 2, with reference to FIG. 10.

In the resonant tone output process S60, it is first determined in S601 whether any key damper flag is newly set in the process in S403 (see FIG. 8). If it is determined that a key damper flag is newly set (S601: YES), a process is executed to instruct the resonant tone generator 116 to generate a new resonant tone (S602).

When the process in S602 is executed, the resonant tone generator 116, which stores the key damper flags for respective keys 111, detects for which key 111 the key damper flag is newly set with reference to the RAM 106, and also detects, with reference to the RAM 106, whether there is any key 111 which has a resonant relationship with the key for which the key damper flag is newly set and which is regularly pressed (i.e., a key 111 for which the SW2 flag is set). If there is any key 111 which has a resonant relationship and also is regularly pressed, a process is executed to instruct the resonant tone generator 116 to output a resonant tone of the key 111 for which the key damper flag is newly set.

If it is determined in S601 that no key damper flag is newly set (S601: NO), then it is determined in S603 whether there is any key damper flag newly reset in the process in S404 (see FIG. 8). That is, it is determined whether any key 111, which is gently pressed without operation of the sostenuto pedal 112 so as to generate a resonant tone, is released, or whether operation of the sostenuto pedal 112 is finished. If it is determined that a key damper flag is newly reset (S603: YES), a process is executed to instruct the resonant tone generator 116 to stop emission of a resonant tone of the key 111 corresponding to the newly reset key damper flag (S604).

When receiving information instructing to mute a resonant tone, the resonant tone generator 116 stops outputting the resonant tone. Accordingly, thereafter, resonant tones except the resonant tone instructed to be muted are generated by the resonant tone generator 116 and outputted by the sound system 122.

When the process in S604 is completed, the resonant tone output process S60 is terminated, and the present process returns to the main process.

A description will now be given of characteristic operation and effects of the electronic piano 1 as described above.

According to the electronic piano 1 of the present embodiment, when a key 111 is gently pressed to the resonant performance position (a position between the key press sensor SW1 and the key press sensor SW2), it is possible to individually output a resonant tone of the gently pressed key 111. Thus, the electronic piano 1 enables a performance to output a resonant tone of a specific key 111 with a similar feeling to that when playing an acoustic piano.

Also, according to the electronic piano 1 of the present embodiment, it is detected whether a key is gently pressed to the resonant performance position using the key press sensor SW1 for detecting a key pressing velocity without separately providing a sensor for detecting whether a key is gently pressed to the resonant performance position. Thus, a simplified configuration of the electronic piano 1 can be achieved.

Further, according to the electronic piano 1 of the present embodiment, when a series of actions to gently press a specific key 111 to an extent to allow output of a resonant tone, to depress the sostenuto pedal 112, and then to release the specific key 111 are performed in a similar manner as on an acoustic piano, the resonant tone of the specific key 111 can be outputted even after releasing the specific key 111. Thus, the electronic piano 1 enables a performance to output a resonant tone of the specific key 111 by operating the sostenuto pedal 112 with a similar feeling to that when playing an acoustic piano.

Hereinafter is described one example of a correspondence relationship between the electronic piano 1 of the present embodiment and an electronic keyboard musical instrument of the present disclosure.

The electronic piano 1 of the present embodiment corresponds to one example of an electronic keyboard musical instrument of the present disclosure.

The key damper flag process executed by the CPU 102 of the present embodiment corresponds to one example of a resonance permission process of the present disclosure.

The key damper flag of the present embodiment corresponds to one example of a resonant tone flag of the present disclosure.

The resonant tone generator 116, the adder 118, the DA converter 120, and the sound system 122 of the present embodiment correspond to one example of a tone emission device of the present disclosure.

The process in S401 of the present embodiment corresponds to one example of a release determination process of the present disclosure.

The process in S404 of the present embodiment corresponds to one example of a cancellation process of the present disclosure.

The process in S402 of the present embodiment corresponds to one example of an operation determination process of the present disclosure.

The processes in S401, S402, and S403 of the present embodiment correspond to one example of a cancellation suspension process of the present disclosure.

Other Embodiments

Although one embodiment has been described above, it is to be understood that the present disclosure is not limited to the aforementioned embodiment, but may be practiced in various forms.

(1) In the aforementioned embodiment, when a gentle key press of a key 111 is detected by the key press sensor SW1, it is determined that the key 111 is gently pressed to the resonant performance position. However, another sensor (a dedicated sensor may be employed) different from the key press sensor SW1 may be provided to determine whether a key 111 is gently pressed to the resonant performance position.

(2) In the aforementioned embodiment, regular tones and resonant tones are outputted using a PCM method. However, a Digital Signal Processor (DSP) method may be employed instead.

(3) Although it is not particularly described in the aforementioned embodiment, there are no dampers for the highest notes in an acoustic piano. Thus, it may be configured such that, when determining whether any key damper flag is newly set (S601), key damper flags are constantly set depending on a tone range even when both of the key press sensors SW1 and SW2 are "OFF."

(4) In the aforementioned embodiment, when a gentle key press of a key 111 is detected by the key press sensor SW1, it is determined that the key 111 is gently pressed to the resonant performance position. A position of the key press sensor SW1 may be varied depending on a desired timbre of a tone.

(5) Although the damper pedal is not specifically described in the aforementioned embodiment, it may be configured such that when the sostenuto pedal is depressed, the damper pedal is subsequently depressed (all strings are in a state of resonance), and then the damper pedal is released, the key damper flag is returned to an original state where the sostenuto pedal is depressed.

(6) Although one key press sensor SW1 and one key press sensor SW2 are provided for each key 111 in the aforementioned embodiment, a plurality of the key press sensors SW1 and a plurality of the key press sensors SW2 may be provided for each key 111.

(7) Elements of the present disclosure are conceptual, and the present disclosure is not limited to the aforementioned embodiment. For example, a function served by one element may be dividedly assigned to a plurality of elements, or functions served by a plurality of elements may be integrally assigned to one element. Also, at least part of a configuration in the aforementioned embodiment may be replaced by a known configuration having a similar function. Further, at least part of a configuration in the aforementioned embodiment may be added to, or may replace, other configuration in the aforementioned embodiment.

What is claimed is:

1. An electronic keyboard musical instrument with a plurality of keys, the electronic keyboard musical instrument comprising:

a detection sensor configured to detect a gentle key press, the detection sensor detecting that a key is gently pressed to an adjacent position that is shallower than and adjacent to a resonant performance position, the resonant performance position corresponding to a key press position to allow a damper to leave a string in an acoustic piano;

a computer configured to, when the detection sensor detects a gentle key press to the adjacent position of at least one first key, among the plurality of keys, execute a resonance permission process to give a permission to output a resonant tone of the at least one first key; and a tone emission device configured to, when at least one second key different from the at least one first key and having a resonant relationship with the at least one first key is regularly pressed, emit a regular tone of the at least one second key and the resonant tone of the at least one first key.

2. The electronic keyboard musical instrument according to claim 1, wherein when the electronic keyboard musical instrument comprises at least two key press sensors configured to detect a gentle key press at at least two different key press depth positions, in order to detect a key pressing velocity, the detection sensor comprises at least one key press sensor of the at least two key press sensors, the at least one key press sensor being configured to detect a gentle key press at the adjacent position shallower than the resonant performance position.

3. The electronic keyboard musical instrument according to claim 1, wherein the computer sets, when the detection sensor detects a gentle key press of the at least one first key, a resonant tone flag to give a permission to output the resonant tone of the at least one first key, and wherein the tone emission device emits the resonant tone of the at least one first key for which the resonant tone flag is set.

4. The electronic keyboard musical instrument according to claim 1, wherein the computer executes:

a release determination process to determine whether the gentle key press of the at least one first key, for which the permission to output the resonant tone is given in the resonance permission process, is released; and a cancellation process, when it is determined in the release determination process that the gentle key press of the at least one first key is released, to cancel the permission in the resonance permission process for the at least one first key.

5. The electronic keyboard musical instrument according to claim 4, further comprising a sostenuto pedal, wherein the computer executes:

an operation determination process, when it is determined in the release determination process that the gentle key press is released, to determine whether an operation of the sostenuto pedal is performed before the gentle key press; and a cancellation suspension process, when it is determined in the operation determination process that the operation of the sostenuto pedal is performed, to suspend cancellation of the permission until the operation of the sostenuto pedal is released.

* * * * *